US005125355A

United States Patent [19]

Stranzinger

[11] Patent Number: 5,125,355

[45] Date of Patent: Jun. 30, 1992

[54] FLOAT

[76] Inventor: Hermann Stranzinger, Gitzen 16, A-5322 Hof b.Salzburg, Austria

[21] Appl. No.: 504,979

[22] Filed: Apr. 5, 1990

[30] Foreign Application Priority Data

Apr. 14, 1989 [AT] Austria ..... 886/89
Sep. 20, 1989 [AT] Austria ..... 2192/89

[51] Int. Cl.[5] ..... B63B 35/44

[52] U.S. Cl. ..... 114/266; 114/263; 114/218

[58] Field of Search ..... 114/263, 266, 267, 125, 114/45-53, 121; 405/218, 219; 14/2.6, 75; 441/35

[56] References Cited

U.S. PATENT DOCUMENTS 2,858,790 11/1958 Russell, Jr. ..... 114/267 X
3,276,209 10/1966 Mosdell ..... 114/267
3,861,340 1/1975 Clingenpeel ..... 114/267
4,487,151 12/1984 Delana ..... 114/266
4,604,962 8/1986 Guibault ..... 114/266
4,799,445 1/1989 Meriwether ..... 114/263 X

FOREIGN PATENT DOCUMENTS 312039 8/1971 Austria .
325094 5/1973 Austria .

*Primary Examiner*—Edwin L. Swinehart
*Attorney, Agent, or Firm*—Collard, Roe & Galgano

[57] ABSTRACT

A float includes a substantially prismatic hollow body, which is made of plastic and which is provided at its side walls, preferably adjacent to its side edges, with connectors for use in assembling a plurality of such floats. In order to reduce the manufacturing costs and to ensure a steady floating behavior, the hollow body is open at its bottom and is formed in its walls with at least one vent hole, which is spaced above the bottom level of the hollow body.

7 Claims, 3 Drawing Sheets

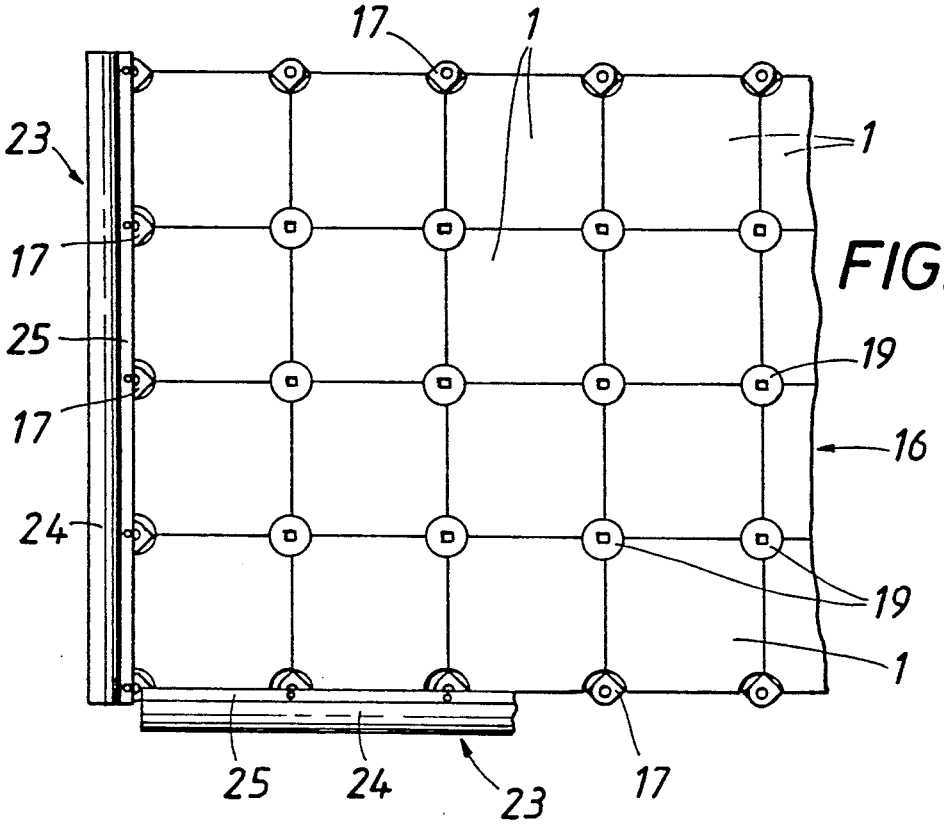
FIG.3
FIG.4
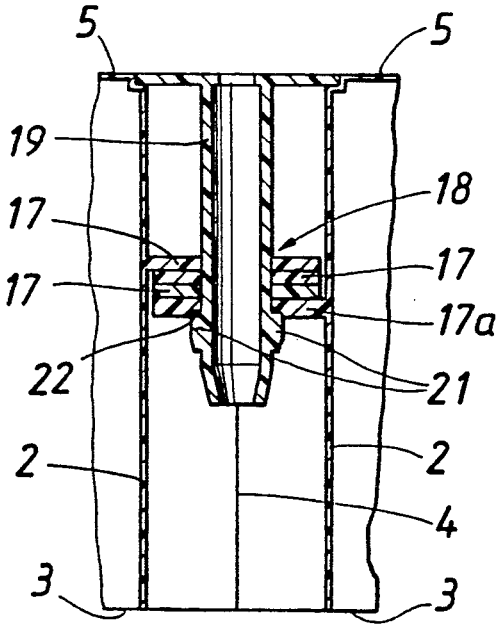
FIG.5
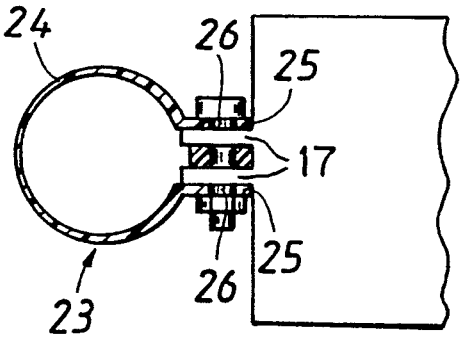

FLOAT

BACKGROUND OF THE INVENTION

1. Field of the Invention

This invention relates to a float comprising a substantially prismatic hollow plastic body, which at its side walls, preferably at its side edge portions, is provided with means for connecting the float to other, identical floats.

2. Description of the Prior Art

Such floats are known from Austrian Patent Specifications 312,039 and 325,094 and can be assembled to form floating platforms, landing stages as well as walk-on platforms, transport rafts, bridges, oil and dirt barriers. They have proved most satisfactory because they have a very large field of application for a very large range of purposes. But the known floats consist of closed hollow bodies, which can be manufactured only at relatively high cost and exhibit a rather unsteady floating behavior and tend to sway under load and under the action of waves.

U.S. Pat. No. 3,861,340 discloses parallelepipedic floats, which consist of a foamed plastic core and a protective sheath made of fiberglass. But said floats are so unstable in water that they cannot be used as individual floats but can be used only in the configuration of a frame, which carries planks forming a platform. Besides, said known floats are rather unhandy and must inherently be made for a specific purpose. This renders their manufacture more expensive and restricts their field of application.

U.S. Pat. No. 3,276,209 discloses floats which consist of concrete and comprise open-bottomed float cells, which are supplied with compressed air through a compressed air system, which comprises for each cell a depending air supply pipe and a vent valve in the top of the cell. Said known floats are expensive, heavy structures, which can be used only for large constructions, such as breakwaters, and as contrasted with hollow plastic bodies are immersed to an excessively large rather than an insufficient depth.

SUMMARY OF THE INVENTION

For this reason it is an object of the invention to eliminate said disadvantages and to provide a float which is of the kind described first hereinbefore and which can be made at low cost, is light in weight and can easily be handled and can be assembled with other floats of the same kind to form a platform or other structure which has a high stability and exhibits a steady floating behavior on a water surface.

That object is accomplished in accordance with the invention in that the hollow plastic body is open at its bottom and is formed in its walls with at least one vent hole, which is spaced from the bottom of the float. Through the open bottom, water can enter the hollow interior of the float as far as to a level which is defined by the location of the vent hole. As a result, the water which has entered the hollow interior of the float will ensure that the float will not sway but will exhibit a steady floating behavior. The open-bottomed hollow body can economically be made, e.g., by injection molding, and the fact that the float has no bottom wall will reduce the expenditure of material and the weight. If the vent hole is relatively small, e.g., is 1 mm or 2 mm in diameter, the float will only slowly subside at a rate which will depend on the rate at which air can escape through the vent hole. On the other hand, air can enter the remaining empty interior space only at a low rate when the vent hole has become open under the action of waves so that a steady position of the float will be ensured substantially independently of the action of waves. A strong swaying or even an undesired lifting of the floats from the water surface will virtually be impossible and the stability of the floating behavior may easily be adopted to various conditions and requirements by a proper selection of the distance of the vent hole from the bottom of the float and by a proper selection of the size of the vent hole.

Within the scope of the invention, the interior of the hollow body may be divided by at least one partition into open-bottomed compartments and the walls defining each compartment may be formed with a vent hole. These features will involve only a low cost and will contribute to the stability of the float when it is floating because the cushions of water in the several compartments will tend to eliminate differences between the water levels and will thus strongly oppose any tilting motion of the float. It is desirable to provide two crossing partitions, which define four compartments, each of which is defined by an external wall that is formed with a vent hole. Alternatively, inner compartments may be provided, which are defined only by partitions and which may communicate through associated vent holes with adjacent compartments or inner compartments may be vented through the top wall of the float although the inner compartments will not contribute to the buoyancy of the float in that case.

At least one wall of the float may be provided with a vertical scale for assisting the determination of the locations at which vent holes are subsequently formed. In that case the vent holes may be formed near the intended site of the float and at locations which can be selected in dependence on the intended conditions of use. Particularly in a float provided with a plurality of vent holes the scale will facilitate the formation of such vent holes at selected distances from the bottom of the float and it will be possible to read the depth of immersion of the float from the scale after the float has been immersed.

Within the scope of the invention a valve may be associated with the or each vent hole. In that case the compartments may be supplied with air or may be vented after the floats have been immersed and in that case the floats can be immersed to a selected depth. Besides, the vent holes which are provided may be connected by air lines to a common, central valve, or each vent hole may be provided with an associated valve. The elevation of the vent holes is not critical but will usually be selected so that an immersion of the float beyond a predetermined depth will be prevented even when the valves have failed to effect a seal.

In a particularly desirable embodiment of the invention the hollow body contains in its interior at least one vertical air duct and said air duct or each of said air ducts is formed with at least one inlet opening spaced above the bottom of the float and communicates with a vent hole at a location spaced above the inlet opening. In such hollow bodies the depth of immersion is not defined by the level on which the vent holes are located but by the level of the inlet openings of the air ducts, which air ducts constantly communicate with the ambient air through the vent holes. The hollow body will uniformly be vented and the float will uniformly subside until the water rising inside the hollow body closes the inlet openings of the air ducts. Because any swaying of the hollow body and any motion of said body under the action of waves will affect the interior of the hollow bodies adjacent to the vent holes only in a damped or alleviated manner relative to the motion of the waves on the outside, an exposure of the vent holes need no longer be feared and the float will be immersed in the water to a constant depth.

The air ducts are desirably joined to the top wall of the hollow body and said top wall is desirably formed also with the vent holes so that the hollow bodies can easily be made in spite of the provision of air ducts and the vent holes disposed at the top will not be constricted or even closed by adjacent floats as such constriction or closing would adversely affect the venting.

In a hollow body subdivided into compartments, each compartment is provided with an air duct and said air ducts are constituted by corner chambers, which are defined by web walls provided near corners formed by vertical inner edge portions of walls. The water cushions in the several compartments will tend to eliminate any differences between water surface levels and will oppose any rocking of the float. The air ducts may be provided in any desired manner, e.g., by an adhesive bonding of plastic tubes. But it will be desirable to provide corner chambers which constitute the air ducts because in that case the provision of the air ducts will involve virtually no additional expenditure if the hollow body is made, e.g., by injection molding, and the web walls of the air ducts will contribute to the stiffening of the hollow body and of the partitions.

From the aspects of appearance and manufacturing technology, the floats have crowned top walls and rounded top edge portions in most cases and a plurality of floats may be superimposed in order to increase the height of the platform. In that case the bottom end faces of the side walls and partitions and of any stiffening ribs may have a profile which matches the rounded configuration of the top wall so that superimposed floats will center and reliably position each other.

The connecting means may comprise lugs, which are vertically offset from each other in such a manner that the lugs of adjacent floats which have been assembled will overlap and may be connected by a common locking pin to form a node. Only two lugs of adjacent floats will be provided on the exposed side walls of a composite platform or the like structure so that there will be no node at said exposed side walls. In a particularly desirable embodiment of the invention a fender is provided, which consists of a longitudinally slotted plastic tube, which at the edges of said slot is formed with outwardly extending fixing flanges. Said fender is adapted to be slidably fitted in a horizontal direction on the overlapping lugs at the adjacent exposed side walls of at least two assembled floats and is adapted to be fixed by screws to such lugs with washers having the same thickness as the lugs interposed. By means of such fender the lugs on the exposed side walls of the platform can be clamped together just as the lugs which form a node so that the floats will be connected by a joint of constant strength also on the outside of the platform. The fender will also protect the platform against an impact of boats and because the fenders are tubular they constitute a conduit for accommodating hoses for a supply of water or cables for a supply of electric power and air ducts for supplying air to the compartments and for venting the compartment may also extend in such conduit.

The plastic tube which constitutes the fender may have a larger wall thickness in its flange portion than in its cylindrical portion. In that case the fender will have the required elasticity for damping the momentum of boats bumping against the fender and the fixing flanges will have the strength required to ensure that the lugs will be held together and the floats will properly be joined.

BRIEF DESCRIPTION OF THE DRAWING

FIG. 3 is a top plan view showing on a smaller scale a floating platform composed of a plurality of floats as shown in FIGS. 1 and 2.

FIG. 4 is a sectional view taken on line IV—IV in FIG. 3 and drawn to a larger scale.

FIG. 5 is a transverse sectional view showing on a larger scale a fender which can be secured to the platform of FIG. 3.

DETAILED DESCRIPTION OF THE PREFERRED EMBODIMENTS

Illustrative embodiments of the invention will now be described in more detail with reference to the diagrammatic drawing.

Figure 1:
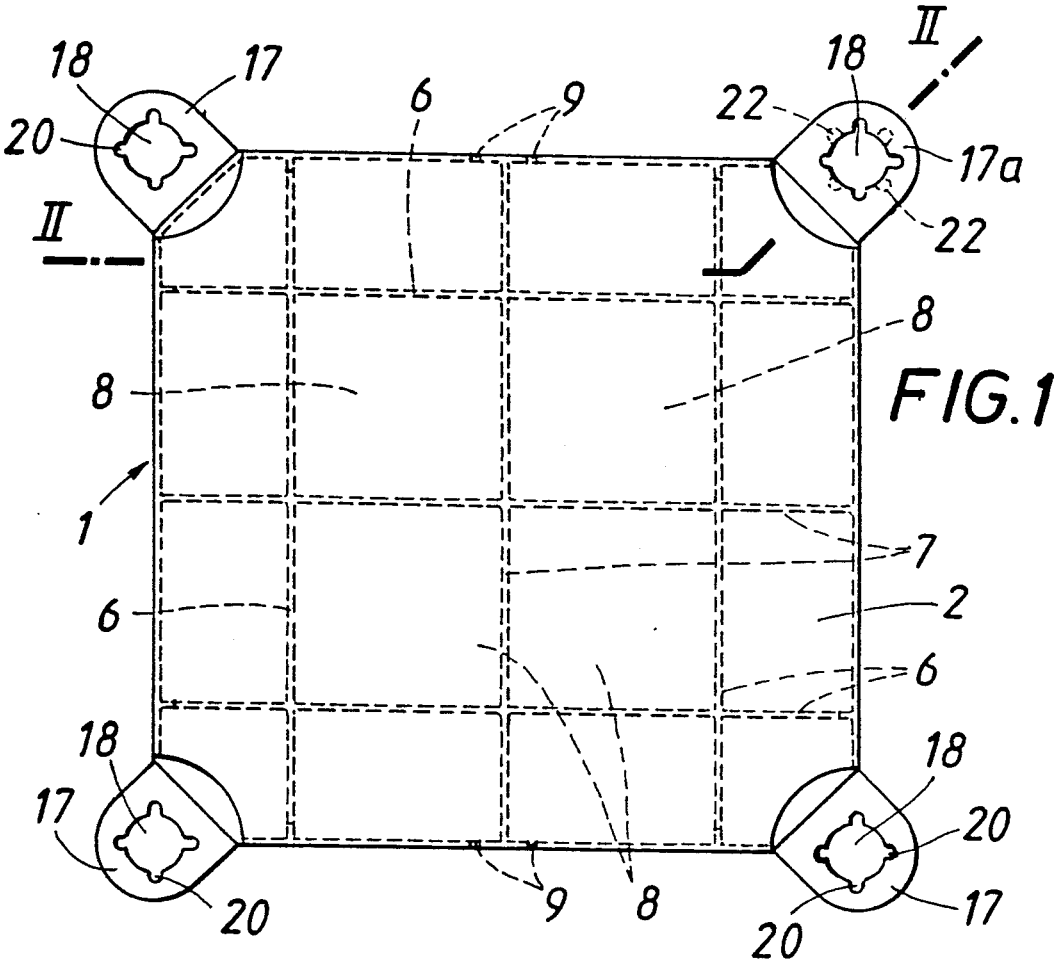
FIGS. 1 and 2 are, respectively, a top plan view and a vertical sectional view taken on line II—II in FIG. 1 and show a float in accordance with the invention.
Figure 2:
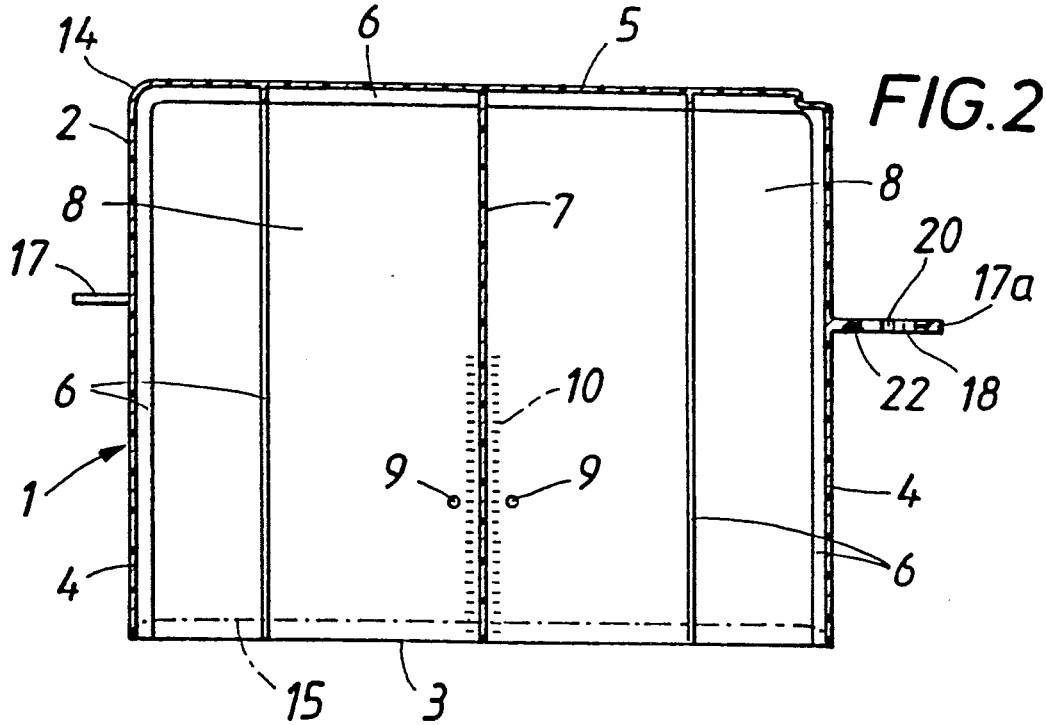
Figure 6:
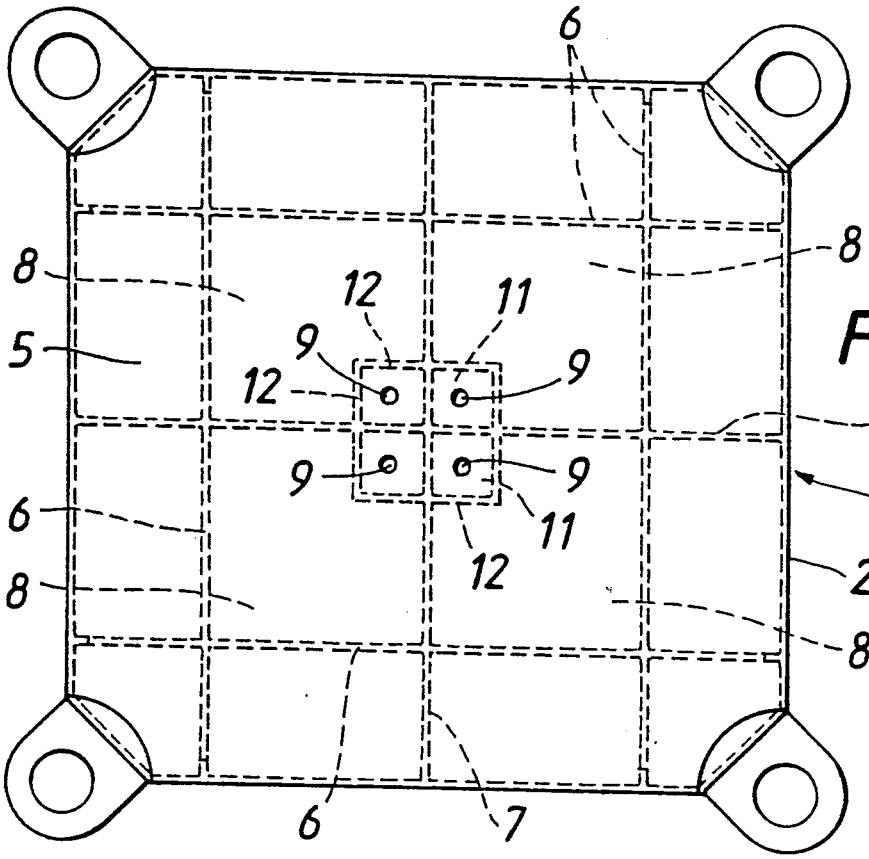
FIGS. 6 and 7 are, respectively, a top plan view and a vertical sectional view showing another illustrative embodiment of a float in accordance with the invention.
Figure 7:
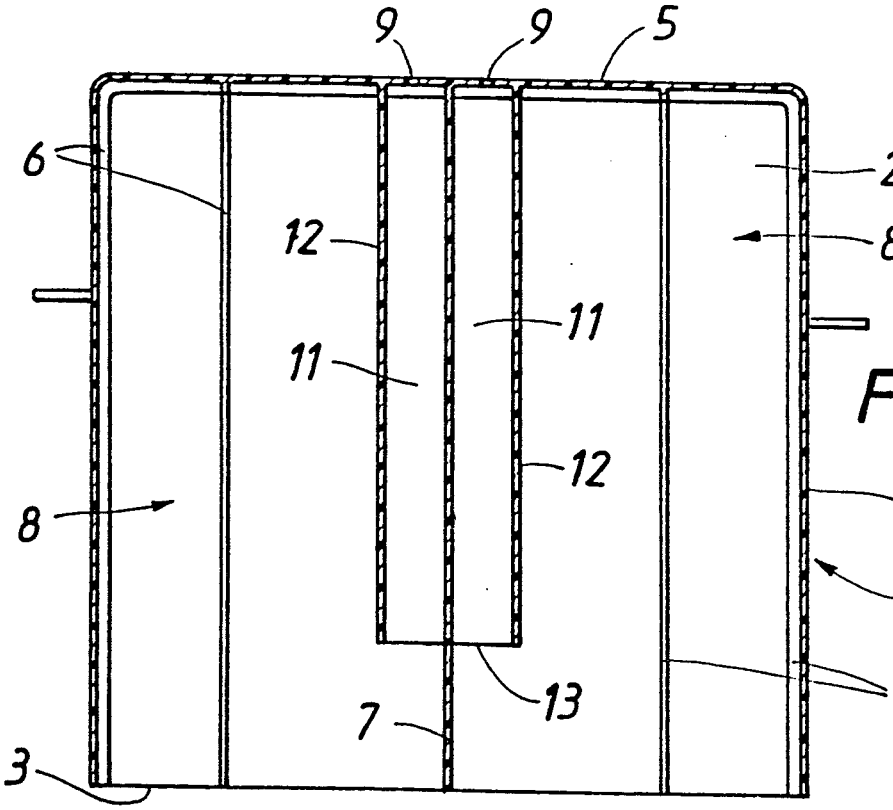

The illustrative float 1 consists of a substantially prismatic hollow body 2, which is made from plastic by injection molding and is open at its bottom 3 and comprises side walls 4 and a top wall 5, stiffening ribs 6 extending along the side walls 4 and the top wall 5, and two crossing partitions 7. The partitions 7 divide the hollow interior of the hollow body 2 into four open-bottomed compartments 8. In the embodiment shown in FIGS. 1 and 2 each side wall 4 is formed with a small vent hole 9, which opens into one of the compartments 8. The vent holes 9 are evenly spaced from the bottom 3. A vertical scale 10 may be provided at a side wall or partition in order to facilitate a determination of the locations for the vent holes 9 and a reading of the depth to which the float 1 is immersed. As is indicated in FIGS. 6 and 7, the top wall 5 may also be formed with vent holes 9, which communicate with respective ones of the compartments. Said vent holes 9 in the top wall 5 open into respective air ducts 11, which depend inside the hollow body 2 from the top wall 5. The air ducts 11 are disposed near the junction at which the partitions 7 cross each other and are defined by web walls 12, which together with corner-forming portions of the partitions 7 define corner chambers. The air ducts 11 depend to a level which is spaced a certain distance above the bottom 3 and at their bottom ends have inlet openings 13.

Said open-bottomed floats 1 will subside in water to a depth which is determined by the level on which the lateral vent holes 9 or the entrance openings 13 are disposed. When the float 1 is immersed to that depth, the water will close the lateral vent holes 9 or the inlet openings 13 and the cushions of compressed air contained in the top portions of the compartments above the surface of the water will exert the required lifting forces. The water which flows into the compartments will ensure a steady floating of the float 1. The subdivision of the hollow interior of the float into compartments will ensure that the float will float without swaying. The internal air ducts 11, which communicate with the ambient air through the vent holes 9 in the top wall 5, will prevent a further venting of the compartments and an unintended change of the depth of immersion even in case of a strong swaying.

If two hollow bodies 2 are superimposed to obtain a higher float, the superimposed hollow bodies can be centered and prevented from slipping relative to each other if the bottom edge faces of side walls, partitions and stiffening ribs have a configuration which conforms to the top wall 5, which has rounded top edge portions 14 and other upwardly convex portions. Such a design is indicated in phantom in FIG. 2.

A plurality of identical floats 1 may be assembled to form a platform 16 or another structure. Each float 1 is provided at its side edges with connecting means consisting of lugs 17. Said lugs of each float 1 are vertically offset from each other and each lug 17 is formed with an opening 18 for receiving a locking pin 19. The openings 18 are formed at their periphery with indentations 20 for receiving mating locking noses 21 of the locking pin 19. The lower lug 17*a* of any stack of overlapping lugs is formed on its underside with recesses 22, which are disposed between adjacent indentations 20 and will receive the locking noses 21 of the locking pin 19 when the same has been inserted through the openings 18 of overlapping lugs 17 and has then been rotated. The locking pin 19 which has thus been set will then be locked against an undesired extraction.

As is particularly apparent from FIGS. 3 and 4, the floats 1 may constitute modules, which may be assembled to form assemblies having various configurations in a top plan view. Four adjoining floats can be connected and held together by means of a common locking pin 19, which can be inserted through the openings 18 of the overlapping lugs 17 of adjacent floats and can be locked in position. Platforms 16 or other structures of any desired shape and size may thus be formed.

A proper connection between the floats is also desired at the exposed side walls 4 of floats 1 which have been assembled to form the platform 16. This can be accomplished in that a fender 23 is slidably fitted onto and fixed by screws to the horizontally spaced apart pairs of overlapping lugs 17 provided at said exposed side walls 4. As is apparent from FIG. 5 the fender 23 consists of a slotted plastic tube 24, which has outwardly extending, slot-defining edge portions, which constitute fixing flanges 25, which are formed with fixing holes 26 having the same spacing as the pairs of overlapping lugs 17 at adjacent side walls 4. Screws are inserted through the fixing holes 26 and through the openings 18 of associated pairs of lugs 17 with washers interposed, and have the same thickness as the lugs so that the fender is screwed to the lugs. The washers substitute the two lugs which would additionally be required to form a node consisting of four overlapping lugs. The plastic tube 24 has a smaller wall thickness in its cylindrical portion than in its flanges so that its stiffness is sufficient to ensure a proper fixation but the cylindrical portion has the desired elasticity and will preferably perform as a fender. Because the fender 23 is tubular, it can be used as a conduit for accommodating and protecting supply lines, such as lines for a supply of water or electric power, which can be installed in a simple manner.

It will be understood that the top surface of the float 1 may be roughened so that slipping will be prevented and that the floats may be provided with conventional additional means.

In the foregoing description and the appended claims the statement that the float is open at its bottom or open-bottomed is applicable also to floats having an apertured bottom wall, provided that in a float which comprises a plurality of compartments such bottom wall must have apertures opening into each of said compartments.

I claim:

1. In a floats when assembled comprising at least two floats, each of which comprises a substantially prismatic hollow body having side walls and a top wall defining a hollow interior and connecting means provided at said side walls and comprising a plurality of lugs, which horizontally protrude from said side walls and at least two of which are vertically offset, wherein said assembled floats have exposed side walls disposed adjacent to each other and provided with two horizontally spaced apart pairs of overlapping ones of said lugs which are vertically offset from each other, the improvement residing in that said hollow body of each of said floats is open at its bottom for an admission of water into said hollow interior, said hollow body of each of said floats is formed in said side walls with vent hole means which are spaced above the bottom of said hollow body and communicate with said hollow interior, and a fender is provided, which consists of a plastic tube, which has a cylindrical portion formed with a longitudinal slot and fixing flanges extending outwardly from said cylindrical portion and along said slot and fitted on said overlapping lugs of said pairs with washers having the same thickness as said lugs interposed between said flanges adjacent to said overlapping lugs of said pairs and screw means are provided, which extend through said flanges, washers and overlapping lugs of said pairs to secure said fender to said overlapping lugs of said pairs.

2. The improvement set forth in claim 1, wherein said cylindrical portion has a smaller wall thickness than said flanges.

3. In a float having a substantially prismatic hollow body having side walls and a top wall defining a hollow interior and connecting means provided at said side walls and adapted to connect said float to identical floats, the improvement comprising:

partition means dividing the hollow interior into a plurality of compartments; and said hollow body is open at its bottom for an admission of water to said hollow interior and said hollow body is formed in said walls with vent hole means spaced above the bottom of said hollow body and communicating with said hollow interior, said vent hole means including a plurality of vent holes which communicate with respective ones of said compartments, spaced above the bottom of the hollow body and communicating with the hollow interior, said hollow body contains in each of said compartments a plurality of vertical air ducts, each of which has an inlet opening spaced above said bottom of said hollow body and communicates with said vent hole means at a distance above said inlet opening, said side walls and said partition means including corner-forming portions adjoining each of said compartments and each of said compartments contain vertical webs joined to said corner-forming portions and together with said corner-forming portions constitute one of said air ducts.

4. The float as set forth in claim 3 in which said hollow body has side edge portions adjacent to said side walls and provided with said connecting means.

5. The float as set forth in claim 3, wherein said partition means comprise partitions crossing each other at a junction and forming said corner-forming portions at said junction.

6. The float as set forth in claim 3, wherein said hollow body is provided on said side walls with a vertical scale.

7. The float as set forth in claim 3 in which said hollow body has rounded edge portions between said top wall and said side walls, wherein said side walls have bottom edge faces, which are vertically aligned with said rounded edge portions and have a profile which matches said rounded edge portions.

* * * * *